United States Patent [19]

Eisenlohr et al.

[11] Patent Number: 5,001,951

[45] Date of Patent: Mar. 26, 1991

[54] APPARATUS FOR CUTTING APART CIGARETTE PACKS IN PREPARATION FOR RECOVERY OF THE TOBACCO IN THE CIGARETTES

[75] Inventors: Gerald Eisenlohr, Kernersville; David R. Jones, Greensboro, both of N.C.; Frank Moorefield, Danville, Va.

[73] Assignee: Lorillard, Inc., New York, N.Y.

[21] Appl. No.: 333,122

[22] Filed: Apr. 4, 1989

[51] Int. Cl.[5] ..... B26D 7/06; B26F 3/00

[52] U.S. Cl. ..... 83/177; 83/101; 83/155.1; 83/416; 83/422; 83/424; 83/435.2; 83/467.1; 83/946; 198/457; 198/464.2; 131/96

[58] Field of Search ..... 83/23, 80, 101, 151, 83/155.1, 163, 177, 416, , 418, 422, 424, 467.1, 931, 946, 435.2; 131/96; 198/457, 461, 464.2

[56] References Cited

U.S. PATENT DOCUMENTS

| | | | |
|---|---|---|---|
| 3,263,543 | 8/1966 | Vassalli | 83/367 |
| 3,386,320 | 6/1968 | Pinkham et al. . | |
| 3,664,483 | 5/1972 | Revaz | 198/461 |
| 4,036,380 | 7/1977 | Berry et al. . | |
| 4,083,499 | 4/1978 | Thatcher . | |
| 4,137,804 | 2/1979 | Gerber et al. | 83/177 |
| 4,191,199 | 3/1980 | Sullivan . | |
| 4,246,838 | 1/1981 | Pulver et al. | 83/177 |
| 4,442,741 | 4/1984 | Whittingham et al. | 83/80 |
| 4,622,875 | 11/1986 | Emery et al. . | |
| 4,679,685 | 7/1987 | Inoko | 198/461 |
| 4,762,219 | 8/1988 | Walters et al. | 198/464.2 |
| 4,778,044 | 10/1988 | Konda | 198/464.2 |
| 4,921,398 | 5/1990 | Fluck | 198/464.2 |

FOREIGN PATENT DOCUMENTS

| | | |
|---|---|---|
| 2346407 | 3/1974 | Fed. Rep. of Germany . |
| 1411267[illegible] | 11/1975 | United Kingdom . |
| 2158410 | 11/1985 | United Kingdom . |

*Primary Examiner*—Frank T. Yost
*Assistant Examiner*—Scott A. Smith
*Attorney, Agent, or Firm*—White & Case

[57] ABSTRACT

Apparatus for cutting cigarette packs transversely in preparation for recovery of the tobacco from the cigarettes therein comprises a first belt conveyor driven at a first velocity, a device for delivering the cigarette packs in collated relation onto the first conveyor with all packs resting on one of their larger sides and oriented lengthwise of the conveyor, and a second belt conveyor arranged coaxially with and adjacent to the downstream end of first conveyor to receive the packs from the first conveyor and driven at a second velocity, the second velocity being higher than the first velocity such that the packs become spaced apart end-to-end on the second conveyor. An indexing conveyor arranged orthogonally to and adjacent to the downstream end of the second conveyor receives each pack from the second conveyor at a receiving station. A photodetector detects the arrival of each pack at the receiving station and produces a signal indicative thereof. A stepper drive advances the indexing conveyor one step to move all packs thereon a selected distance greater than the width of the largest size pack in repsonse to each such signal and then stops the indexing conveyor until the next pack arrives and is detected at the receiving station. A water jet cutter cuts each pack and the cigarettes therein transversely as they move along the indexing conveyor.

13 Claims, 4 Drawing Sheets

APPARATUS FOR CUTTING APART CIGARETTE PACKS IN PREPARATION FOR RECOVERY OF THE TOBACCO IN THE CIGARETTES

BACKGROUND OF THE INVENTION

As do many industries, the cigarette manufacturing industry has finished products, cartons of cigarettes, that are not satisfactory for shipment or that have been returned by reason of being out of date, damaged or withdrawn from the market, such as products left after marketing trials. Most of the tobacco in the cigarettes is of good quality, and because of the high cost of tobacco, it is highly advantageous economically to recover the tobacco for use in the manufacture of new cigarettes.

The reclaiming of the tobacco from the finished, packaged product requires, of course, first opening the cartons and packs, then removing the cigarettes from the packs and finally separating the tobacco from the cigarette wrappers and the filters (in the case of filter-tipped cigarettes).

A part of the tobacco reclaiming process that has proven to be very troublesome to carry out using high speed automatic equipment is that of opening the packs in such a way as to leave the packaging materials (cellophane outer wrapper, paper wrapper and foil inner wrapper) in large pieces, that is, free of small pieces that are not easily separated later on from the tobacco. Also, it is desirable, but not easy, to separate the tobacco from the cigarette wrappers and filters (where involved) in a manner that leaves large pieces of wrappers and largely intact filter plugs, free of slivers and other small pieces.

In U.S. Pat. No. 3,386,320 (Pinkham et al., June 4, 1968) it is proposed to open cigarette packs by slitting the wrappers lengthwise along each narrower side and then cutting the entire packs and cigarettes into two parts transversely using rotating cutting blades. U.S. Pat. No. 4,036,380 (Berry et al., July 19, 1977) describes and shows a machine for cutting off both narrower side walls of cartons and both end walls of the packs and then blowing on the cigarettes with air jets. It is well known that cutting paperboard and paper with blades is a tricky operation; the blades must be kept very sharp, and even with sharp blades making clean cuts without tearing off slivers and small fragments is virtually impossible. As a result, machines using blades to cut open packs have not been used extensively in the industry.

Equipment for ripping open cartons and packs and for separating the cigarettes in a cyclone separator is described in U.S. Pat. No. 4,083,499. The cartons and packs are literally beaten apart by impacts of the blades of a ripper fan and by hurling them against breaker rods. Because of the random nature of the impacts, the equipment is prone to producing small fragments, and the opportunity for the wrapping materials to get caught upon the blades and pins and to be torn when they break away further contributes to production of small fragments of wrapping materials that are difficult to separate from the tobacco.

The main thrust of the apparatus of U.S. Pat. No. 4,622,875 (Emery et al., Nov. 18, 1986) is the sorting of different types of cigarettes, for example by brands, by features (menthol/non-menthol or filter/non-filter) or by capability/non-capability of reuse, for opening in separate conveyors using water jets. No mechanical details of the apparatus for transporting and handling the packs being opened are described or shown in the patent disclosure. It is generally known in the industry that equipment using at least some of the technology of this patent was built but that there were so many problems with it that it is no longer in use. The extent to which it was used successfully is not known.

SUMMARY OF THE INVENTION

An object of the present invention is to provide apparatus for opening cigarette packs in preparation for reclaiming the tobacco that produces a minimum of small fragments of packaging materials that are difficult to separate from the tobacco, and in particular, apparatus that cuts the packages and cigarettes cleanly without tearing or shredding. Another object is to provide equipment that will operate reliably with a minimum of downtime for maintenance or as a result of malfunction. Still another object is to permit the handling and opening of the packages to be carried out at high speed, thereby maximizing the throughput and reducing the investment in equipment and plant space required to handle a high volume of product. It is also an object of the invention to provide a machine that operates automatically with little need for oversight by personnel. Advantageously, another object is to have the ability to handle cigarette packs of different sizes and packs of both filter and non-filter cigarettes.

In accordance with the invention, apparatus for cutting cigarette packs comprises a first belt conveyor driven at a first velocity, a collator device for delivering the cigarette packs in collated relation onto the first conveyor with all packs resting on one of their larger sides and oriented lengthwise of the conveyor, and a second belt conveyor arranged coaxially with and adjacent to the downstream end of first conveyor to receive the packs from the first conveyor and driven at a second velocity. The second velocity is higher than the first velocity such that the packs become spaced apart end-to-end on the second conveyor. An indexing conveyor is arranged orthogonally to and adjacent to the end of the second conveyor downstream to receive each pack from the second conveyor at a receiving station. A detector device detects the arrival of each pack at the receiving station and produces a signal indicative thereof, and a drive device advances the indexing conveyor one step to move all packs thereon a selected distance greater than the width of the largest size pack in response to each such signal and thereafter causes the indexing conveyor to dwell until the next pack arrives and is detected at the receiving station. Each pack and all of the cigarettes therein are cut transversely as the packs move along on the indexing conveyor.

Preferred embodiments of the invention are characterized by the following features, alone or in combination:

(1) an impeller at the downstream end of the second conveyor transfers each pack to the receiving station of the indexing conveyor at a velocity substantially greater than the second velocity;

(2) the cutting device is a high pressure water jet;

(3) the indexing conveyor includes a rigid stationary bed extending along its entire length and adapted to support the packs against the forces of the impingement of the water jet and pusher bars driven by the drive device and engageable with the packs on the conveyor to advance them along the bed;

(4) the bed has a hole through which the water jet passes after cutting through the packs and cigarettes, and a tube is arranged in sealed relation to the perimeter of the tube on the under side of the bed to receive and confine the water jet;

(5) a vacuum aspirator is coupled to the tube for maintaining a vacuum in the tube and for aspirating water splash from the jet as it impinges on the packs;

(6) the water jet is directed against the packs at an angle oblique to the bed with a velocity component in a direction opposite to the direction of movement of the packs along the indexing conveyor, such that the jet impinges initially at the lower leading corner of each pack as the cut is initiated and the cut then propagates upwardly along the leading edge of the pack;

(7) a rotatable dancer roll at the end of the first conveyor maintains frictional engagement of each pack with the first conveyor for movement at the first velocity until it disengages from the roll, such that the point of transfer from the first conveyor to the second conveyor with respect to the trailing end of each pack is substantially uniform from pack to pack and substantial uniformity of the spacing between the packs on the second conveyor is ensured;

(8) the impeller device is a brush located above the packs for engagement with them and driven in rotation at a peripheral velocity substantially greater than the velocity of the second conveyor;

(9) the indexing conveyor includes an endless driven chain on either side of the bed and a row of uniformly spaced-apart pusher bars carried by each of the driven chains, the pusher bars extending orthogonally to the path of movement of the packs along the bed part way across the bed for engagement with the trailing edges of the packs and having their ends spaced apart so that the pusher bars do not pass through the water jet;

(10) the chain on the side of the bed remote from the second conveyor carries stop bars located to be engaged by the ends of the packs and establish their transverse positions on the bed of the indexing conveyor; and

(11) a device is provided at the receiving station of the indexing conveyor for counteracting rebounds of the arriving packs and establishing engagement of the packs with the respective stop bars; such device may be a brush located above the packs, engageable with them and driven in rotation in a direction to move them into engagement with the respective stop bars.

For a better understanding of the invention, reference may be made to the following description of an exemplary embodiment, taken in conjunction with the accompanying drawings.

DESCRIPTION OF THE EMBODIMENT

Figure 1:
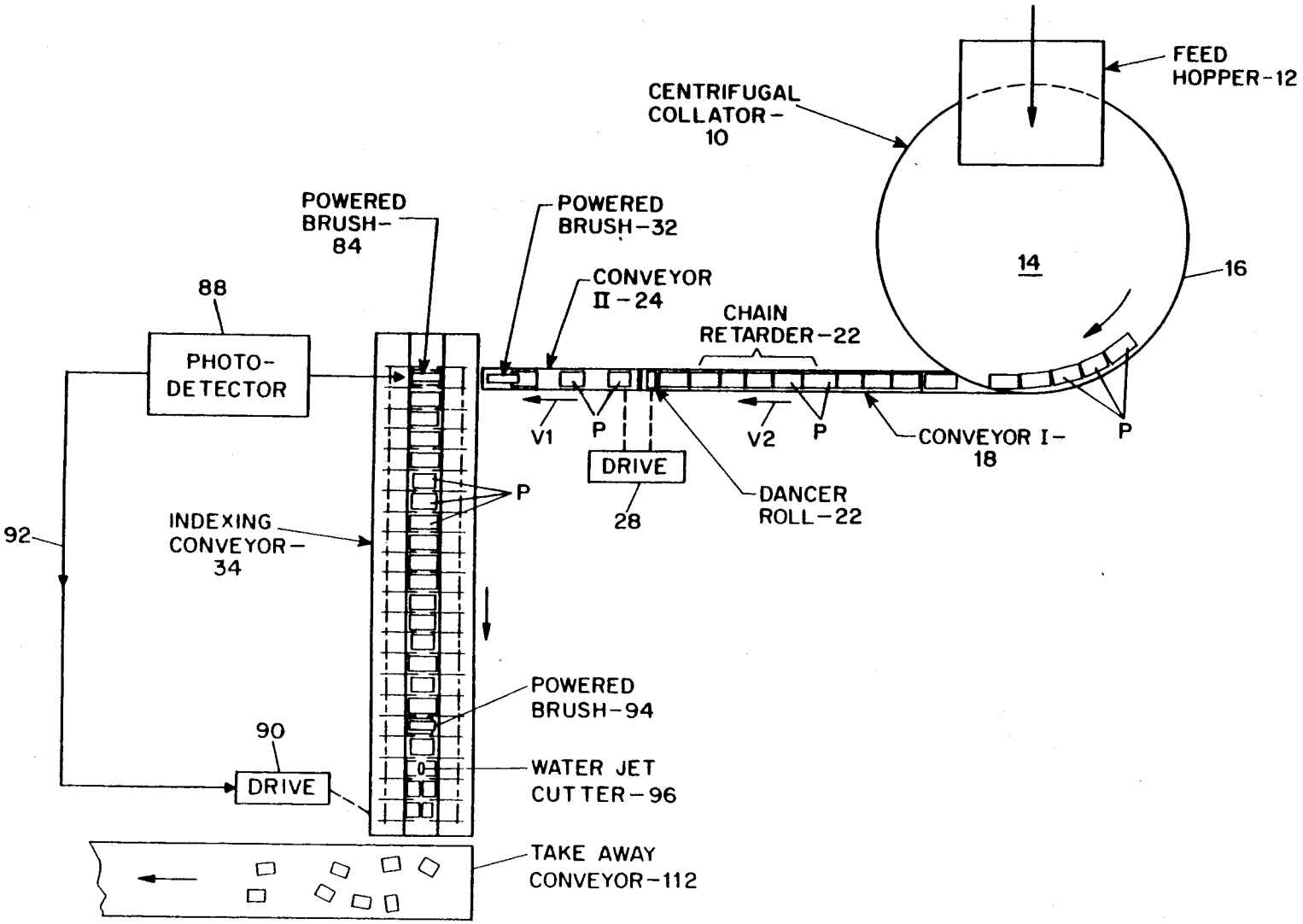
FIG. 1 is a top plan view in generally schematic form of the embodiment.

The machine is designed to receive and cut apart transversely packs of cigarettes that contain tobaccos of blends sufficiently similar to enable them to be used together in making new cigarettes. To this end, the packs supplied to the machine are previously sorted to exclude cigarettes that are dissimilar. For example, menthol cigarettes will be previously sorted out. On the other hand, the machine is designed to handle packs of different sizes and both filter and non-filter cigarettes delivered to the machine at random. Accordingly the sorting process prior to delivery of the packs to the machine is much simpler than would be necessary if only packs of the same size or cigarettes of the same type (filter or non-filter) could be processed.

The first element of the machine is a centrifugal collator 10, to which the cigarette packs are delivered by a feed hopper 12 from a conveyor (not shown) that is controlled, such as by a detector (not shown) associated with the collator 10, to deliver packs periodically to the hopper 12 when the contents of the hopper is relatively low. The collator 10 is per se a well-known device (see, for example U.S. Pat. Nos. 3,224,554, 3,065,839 and 2,662,632) for aligning and feeding similar articles end to end and flatwise. It has rotating, conical shaped bottom wall 14, a stationary outer wall 16 and an outlet trough 18. Not shown are a stationary separator ring set in from the wall 16 and spaced above the bottom by a distance slightly greater than the narrower transverse dimension (thickness) of the thickest packs to be processed. Most packs fed to the collator almost immediately fall flatwise onto the bottom 14 and slide outwardly by centrifugal force to the perimeter and under the separator ring up against the perimeter wall 16. Many of the packs, also by centrifugal force, become oriented with their longest axes (lengthwise) oriented in the circumferential direction. Packs that do not initially fall flatwise are rejected by the separator ring and encounter a rapidly rotating rejector roll located near the outlet through 18, which propels them generally inwardly. A guide (not shown) deflects packs which lie flatwise but are not oriented circumferentially either to the rejector roll or reorients them to the desired circumferential orientation. Sooner or later, all packs received by the collator 10 end up flatwise and circumferentially oriented for delivery from the collator in an end to end row through the delivery trough 18.

A first belt conveyor 20 ("CONVEYOR I"), moving in the direction indicated by the arrow V1 in FIG. 1, receives the packs from the trough 18. Part way along the conveyor 20 and above it is a drooping link chain retarder 22 (indicated schematically) which engages two or three of the packs at a time and by its weight increases the frictional force between the packs it engages and the belt, thereby slowing the packs down to the velocity of the belt 20. In this regard the bottom of the collator 10 is driven at a peripheral speed slightly greater than the speed of the conveyor 20 so that any gaps between packs leaving the collator are taken up on the conveyor 20; the collator can overfeed the conveyor by pushing the packs faster than the belt, but the chain retarder slows the packs to the speed of the conveyor. At times the packs may back up end to end into the collator; on the other hand there can be occasional gaps between packs on the conveyor 20. The operation of the collator is somewhat variable, but it has the important practical advantages of being simple, inexpensive, trouble-free and fast.

Most of the time the packs arrive at the downstream end of the first belt conveyor 20 in end-to-end engagement; as is described below, it does not, however, matter if there are occasional gaps between the packs. Referring to FIGS. 6A to 6E, when a given pack P1 arrives at the end of the conveyor 230, it encounters and is engaged (FIG. 1) by a lever-mounted, gravity dancer roll 22 (a stop, not shown, limits the downward movement to a point slightly below the height of the thinnest packs handled in the machine). As the pack P1 is engaged by the roll, the frictional force between it and the belt 20 is increased to ensure that the pack continues to move at the speed of the first belt 20. The upstream end of a second endless conveyor belt 24, which is aligned with and adjacent to the first belt 20 ("CONVEYOR II" in FIG. 1), is driven at a speed substantially greater, say twice, than that of the belt 20 in the direction of the arrow V2 in FIG. 1. As the pack P1 is pushed off the end of the first belt 20 and onto the second belt 24 (FIG. 6B), the dancer roll 22 restrains the pack from being pulled off the belt 20 by the belt 24, because the frictional force between the pack and the belt 20 is greater than that between the pack and the belt 24. The dancer roll is centered over or slightly upstream from the downstream drive roll 26 of the belt to ensure that the pack P1 is not pulled from the belt 20 until it disengages from the dancer roll (FIG. 6C). At this point the pack P1 is picked up by the faster belt 24 and is quickly accelerated to the speed V2 of the faster belt.

Meanwhile, the next following pack P2 continues to travel at the velocity V1 of the belt 20. During the time that pack P1 travels at the velocity V2 and the pack P2 travels at the velocity V1, a space between the packs P1 and P2 forms (FIGS. 6D and 6E). The space, of course, remains after the pack P2 is picked up by the faster belt 24, so the packs are transported to the downstream end of the second conveyor 24 in spaced-apart relation. The dancer roll 22 or an equivalent device is important to establish substantial consistency of the points of transfer of all packs relative to their trailing ends. The dancer roll is advantageous because it is insensitive to the lengths of the packs. Cigarettes are usually 80 mm, 100 mm or 120 mm in length, and the dancer roll accommodates all of those sizes. It is also simple and reliable and requires no drive and no electronics to establish the spacing between packs that is required for subsequent handling of the packs.

Figure 6A:
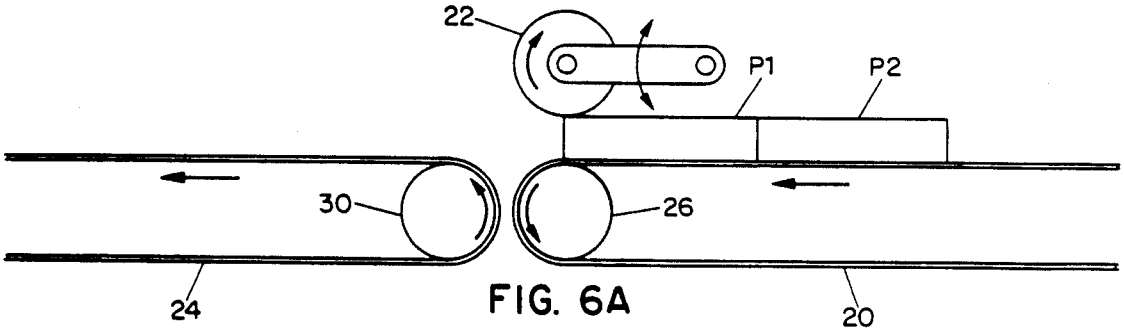
FIGS. 6A through 6E are side views in generally schematic form showing in sequence how the packs are transferred from the lower speed conveyor to the higher speed conveyor to separate them so that there is open time to transfer them to the indexing conveyor and move the conveyor one step before the next pack arrives.
Figure 6B:
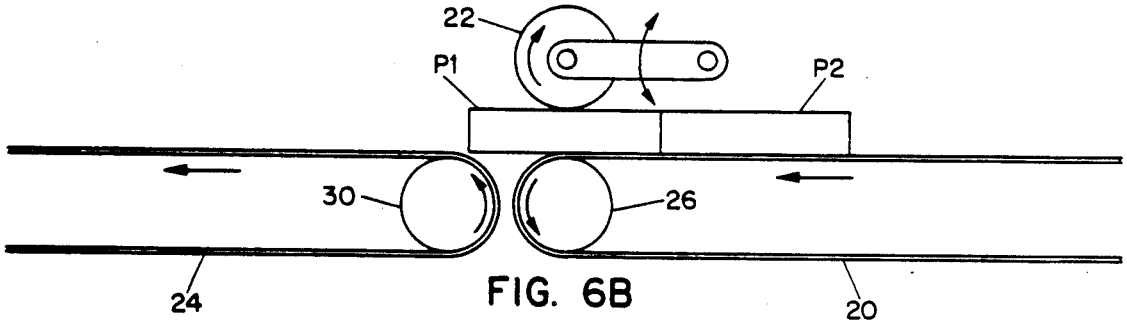
Figure 6C:
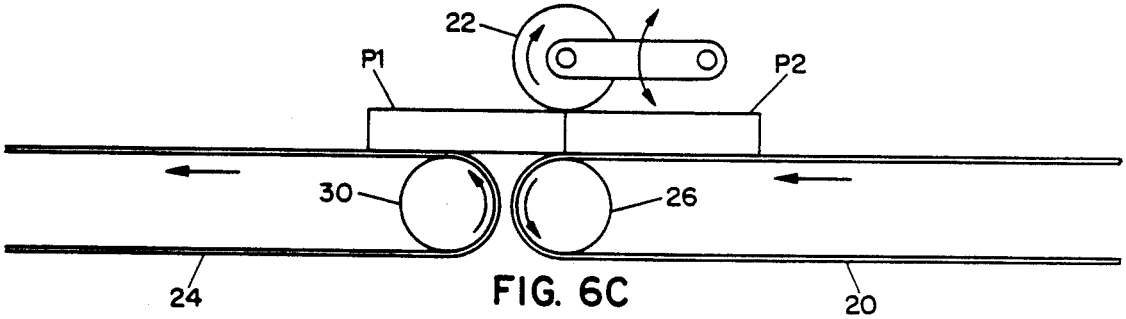
Figure 6D:
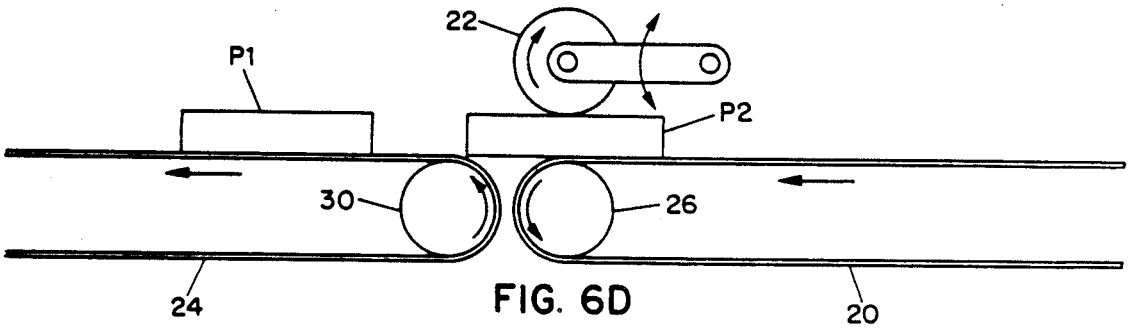
Figure 6E:
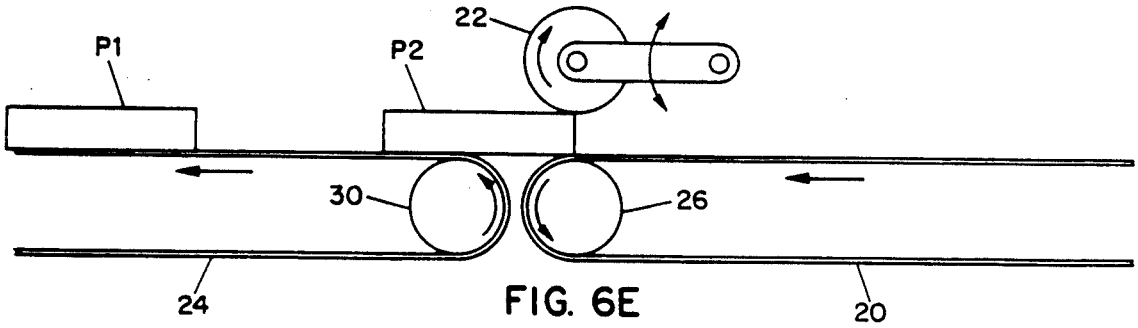

The belt conveyors 20 and 24 are driven by a common belt drive 28 (FIG. 1, of course with different sized belts and pulleys for the respective belts) associated with belt carrier rolls 26 and 30 (e.g., FIG. 6A). Each belt 20 and 24 has guide rails along both sides spaced-apart a distance slightly greater than the width of the widest packs to be processed by the machine.

Above a roller bridge (not shown) located downstream from the downstream end of the second conveyor 24 is a powered brush impeller 32 (shown schematically on FIG. 1), which is positioned so that the bristles engage the packs as they arrive and are pushed onto the bridge. The brush is rotated at a relatively high peripheral speed such as to propel each pack rapidly into the receiving station of an indexing conveyor 34. The roller bridge is simply a series of transverse rolls mounted on a frame that provides a low friction support for the packs between the end of the second conveyor 24 and the indexing conveyor 34 and provides minimum frictional restraint on the action of the brushes in transferring the packs to the indexing conveyor.

Figure 2:
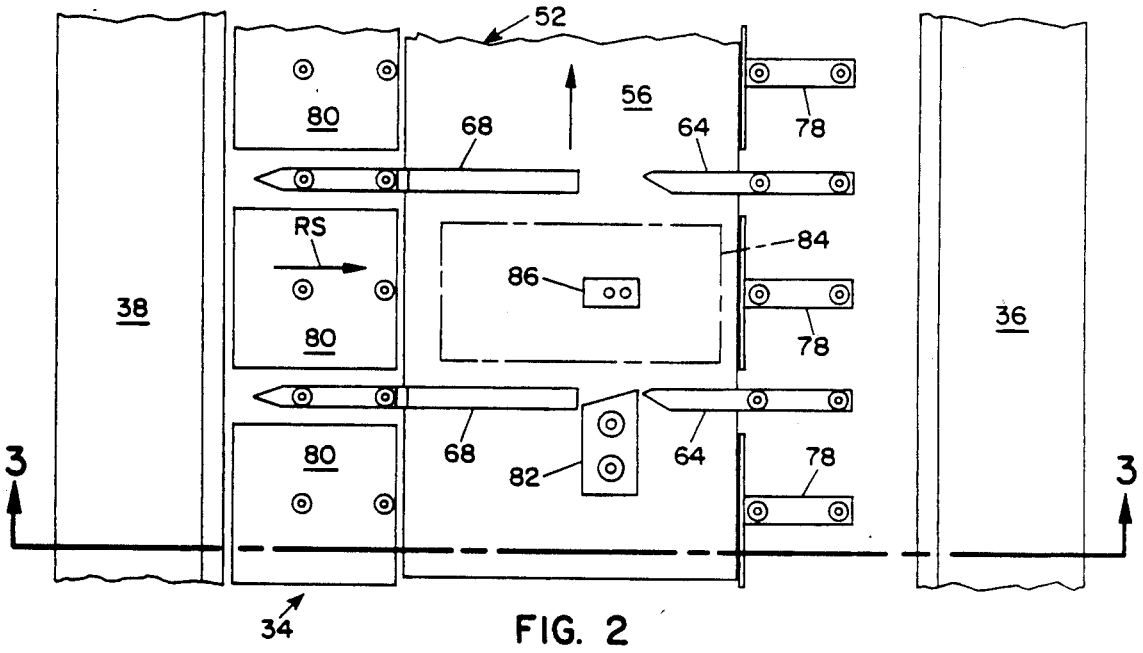
FIG. 2 is a top plan view of a portion at the receiving station of the indexing conveyor of the embodiment.
Figure 3:
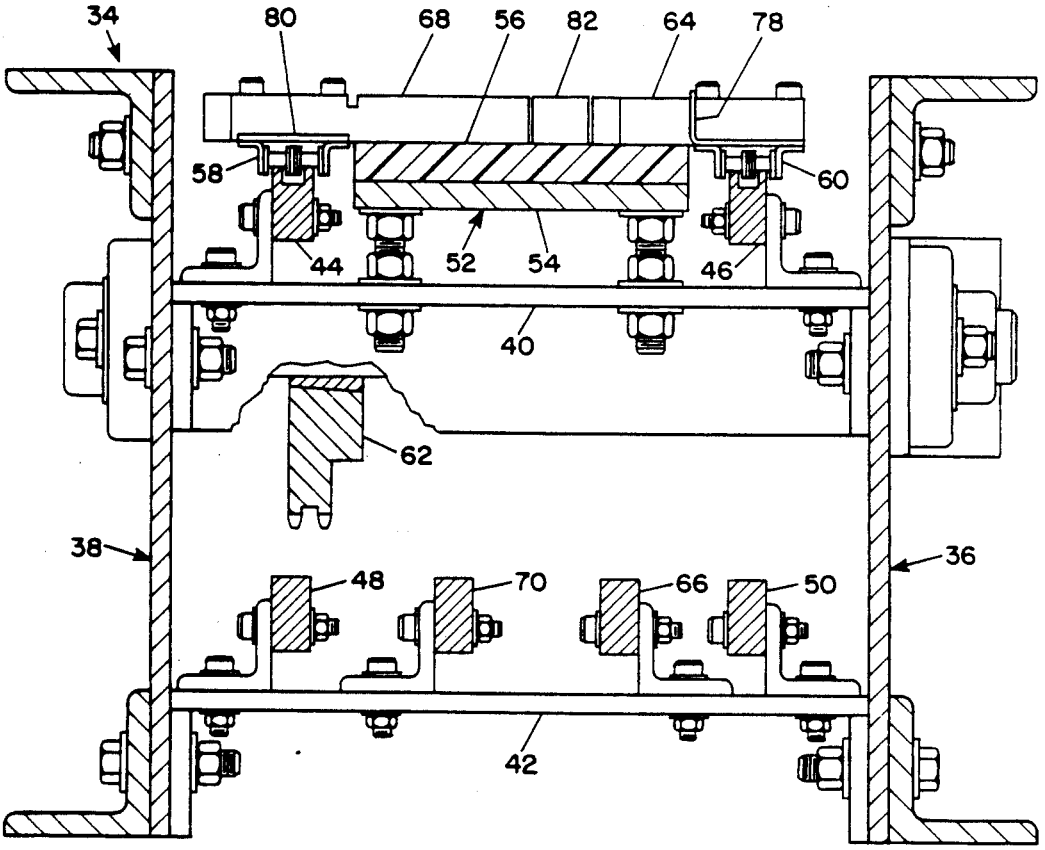
FIG. 3 is a cross-sectional view, somewhat simplified, of the indexing conveyor taken generally along the lines 3–5 of FIG. 2.

Referring to FIGS. 2 and 3, the indexing conveyor 34 has a pair of side frame members 36 and 38 built up from plates and angles and joined by upper and lower crosspieces 40 and 42 at suitable intervals. A pair of upper chain tracks 44 and 46 are mounted on the upper crosspieces, and a pair of lower chain tracks 48 and 50 are mounted on the lower crosspieces. Also mounted on the upper crosspieces 40 is a stationary bed 52, which consists of a metal structural supporting member 54 and a low friction supported member 56. On either side of the bed 52 is an endless roller link chain 58 and 60. Each chain is stretched between sprockets 62 (only one is shown in part in FIG. 3) carried by shafts journalled in the side frames 36 and 38 at the upstream and downstream ends of the index conveyor. The mechanical details of the sprockets, shafts and journals are not shown in the drawings because they are, of course, conventional in machine design. Also, in FIG. 2 the details of the chains are omitted for clarity.

Every other link of the chain 60 carries a pusher bar 64 that extends inwardly and transversely partway across the top of the bed 52 along the upper run of the chain and is supported along the lower run by a support rail 66. Similarly, every other link of the chain 58 carries a pusher bar 68, which extends partway across the bed and is supported along the lower run by a support rail 70. The free inner ends of the respective pusher bars 64 and 68 are spaced apart so that the pusher bars do not pass through the water jet by which the packs are cut apart, as described below.

The remaining links of the chain 60 receive stop members 78 which catch the packs as they are propelled by the power brush 32 onto the indexing conveyor and register the packs endwise for cutting along the desired location. Affixed to the remaining links of the chain 58 are bridge plates 80, which support the packs as they traverse the gap between the roller bridge and the bed 52 at the receiving station.

The arrowed line RS in FIG. 2 designates the receiving station of the indexing conveyor and also points in the direction in which the packs move in arriving. A stationary guide block 82 affixed to the bed 52 at the gap between the ends of the pusher bars ensures that misaligned packs arriving on the conveyor do not catch on the end tips of the pusher bars 64. Rebounding of the packs off the stops 78 is controlled by a powered brush 84 above the receiving station of the conveyor.

An optical sensor 86 of a photodetector 88 is installed under the bed and views the receiving station through a hole in the bed. When each pack arrives at the receiving station, the photodetector 88 signals over a line 92 a stepper drive 90, which drives the conveyor chains 58 and 60 via the downstream sprocket shaft. At the signal the stepper drive advances the chains, pusher bars, stops and bridges one step. The stepper drive is programmed to move the chains a distance equal to the spacing lengthwise of the conveyor between adjacent pusher bars. That spacing is slightly greater than the widths of the widest packs to be processed in the machines. The drive stops (dwells) at that point to await the arrival of the next pack.

The relative speeds of the conveyors 20 and 24 are established so that enough space is opened up between adjacent packs on the second conveyor 24 to provide time for transfer of the packs to the indexing conveyor. While a pack is flicked onto the indexing conveyor by the powered brush 32 and the conveyor indexed one step to present the next slot at the receiving station, the next following pack is still moving along the second conveyor 24. When the packs arrive in end-to-end engagement at the downstream end of the first, slower conveyor 20, the transfer to the second conveyor provides a fairly uniform spacing between the packs and the second conveyor, and leaves fairly uniform open times for transfer of packs to the receiving station on the indexing conveyor and indexing one step. When there is a gap between packs on the first conveyor, as occurs from time to time, there will be a larger gap on the second conveyor and a longer open time for pack transfer and indexing. The photodetector control of the indexing conveyor will hold the indexing conveyor in readiness to receive the next pack until its arrival is detected by the optical sensor 86.

The start-stop indexing motion of the indexing conveyor can jiggle the packs such that they move away from the stops 78. Accordingly, just upstream from the water jet cutting station of the conveyor and above the bed is a powered brush 94 for pushing the packs back against the stops 78 as they pass under.

Figure 4:
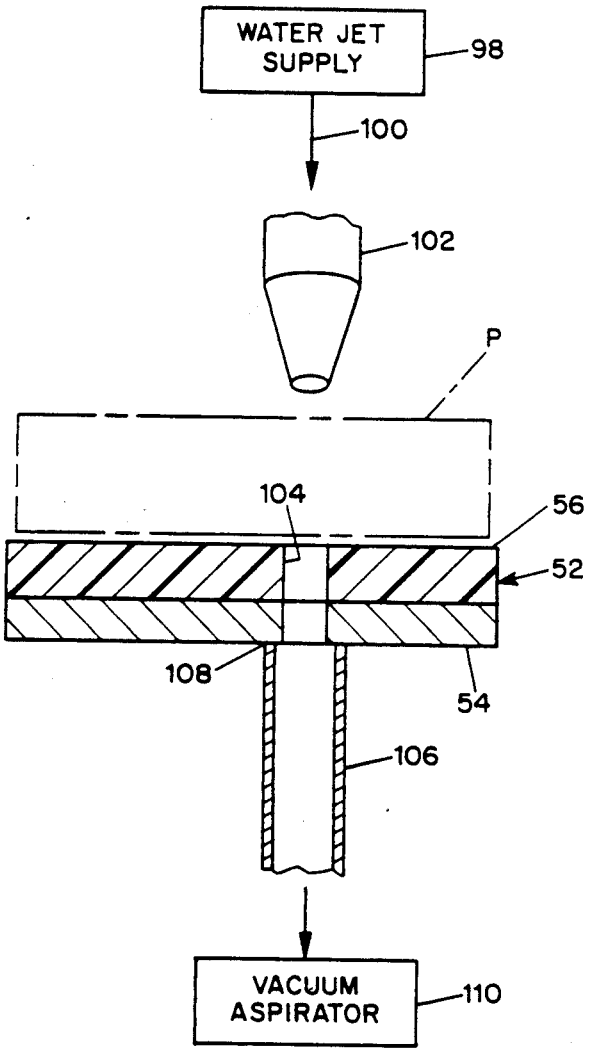
FIGS. 4 and 5 are sectional detail views from the front and the side, respectively, and in schematic form of the water jet cutting system of the embodiment.
Figure 5:
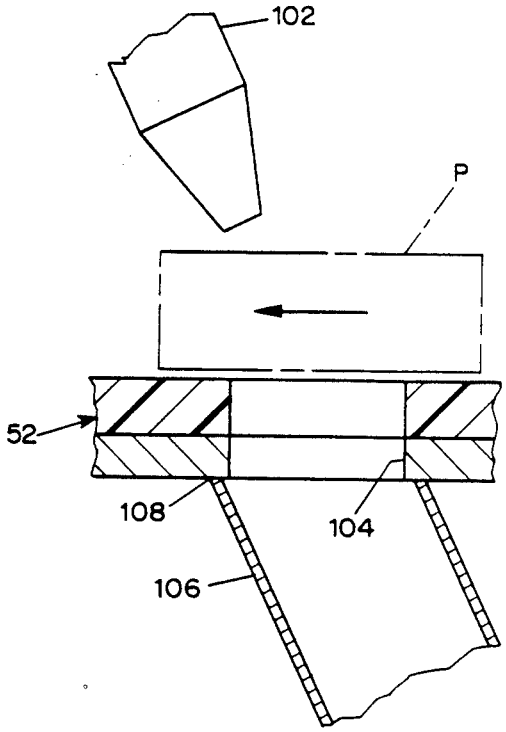

A water jet cutter 96 is located near the downstream end of the indexing conveyor. As shown generally schematically in FIGS. 4 and 5, the cutter system comprises a water jet supply 98, which is a commercially available unit that supplies water under very high pressure, a supply conduit 100 and a jet nozzle 102. The nozzle is positioned above the conveyor bed 54 and is oriented to direct the water jet obliquely against the packs P as they move under the nozzle with a velocity component in an upstream direction with respect to the direction of movement of the packs. The force of the water jet is quite high, and the bed 52 and pusher bars 64 and 68 are called upon to hold the packs against that force. The orientation of the water jet is such that the cut is initiated at the lower, leading corner of the pack, so there is no chance of tipping or ejection of the pack by the jet. The jet cuts very cleanly through the wrapping materials on the cigarettes, the cut advancing along the width of the pack as the conveyor moves the pack downstream. As mentioned above, the clearance between the nearer ends of the pusher bars 64 and 68 is provided so that the jet does not impinge on them as they move through the cutter.

The water jet exits from the packs and passes through a slot 104 in the conveyor bed 52 and into a discharge tube 106 that is sealed at a juncture 108 with the support plate 54 of the bed 52. The tube leads to a vacuum aspirator 110, which is simply a closed vessel at the lower end of the tube 106 that is coupled to a vacuum source. When the jet impinges on the packs as they are cut, there is some splashing. The vacuum aspirator 110 is very effective in sucking virtually all water that splashes, which is largely atomized particles like a mist, into the hole; the conveyor stays very clean over several hours of constant running of the machine. When the jet impinges on the bottom of the aspirator collector vessel, it is atomized, and the water droplets and the particles of the wrappers and cigarettes removed by the jet are aspirated by the vacuum and carried through the vacuum line to a receiver tank. The vacuum aspirator system remains very clean in operation and is virtually maintenance-free.

The water jet nozzle 102 is located transversely of the conveyor, relative to the stops 78, such that packs of all sizes and packs of both filter and non-filter cigarettes are cut cleanly along lines through the tobacco rod parts of all cigarettes. It does not matter which ends of the packs of filter-tipped cigarettes are against the stops. The ability to handle all sizes of packs and the absence of a need to orient filter cigarettes endwise is a significant advantage.

The water jet cuts the packs very cleanly without making any rips or tears or severing small pieces of wrapping materials or the cigarettes. The two segments of the packs are indexed along the conveyor and dumped off the end to a take-away conveyor 112 (FIG. 1), which transports them to tobacco reclaiming equipment, such as the commercially available MCM Cigarette Reclaim System.

We claim:

1. Apparatus for cutting cigarette packs transversely in preparation for recovery of the tobacco from the cigarettes therein comprising a first belt conveyor driven at a first velocity, means for delivering the cigarette packs in collated relation onto the first conveyor with all packs resting on one of their larger sides and oriented lengthwise of the conveyor, a second belt conveyor arranged coaxially with and adjacent to the downstream end of first conveyor to receive the packs from the first conveyor and driven at a second velocity, the second velocity being higher than the first velocity such that the packs become spaced apart end-to-end on the second conveyor, an indexing conveyor arranged orthogonally to and adjacent to the downstream end of the second conveyor to receive each pack from the second conveyor at a receiving station, means for detecting the arrival of each pack at the receiving station and producing a signal indicative thereof, drive means for advancing the indexing conveyor one step to move all packs thereon a selected distance greater than the width of the largest size pack in response to each such signal and to thereafter cause the indexing conveyor to dwell until the next pack arrives and is detected at the receiving station; and means for cutting each pack and the cigarettes therein transversely as they move along on the indexing conveyor.

2. Apparatus according to claim 1 and further comprising impeller means at the downstream end of the second conveyor for transferring each pack to the receiving station of the indexing conveyor at a velocity substantially greater than the second velocity.

3. Apparatus according to claim 2 wherein the impeller means is a brush located above the packs, engaging with the packs and driven in rotation at a peripheral velocity substantially greater than the velocity of the second conveyor.

4. Apparatus according to claim 1 wherein the cutting means is a high pressure water jet.

5. Apparatus according to claim 1 wherein the indexing conveyor includes a rigid stationary bed extending along its entire length and adapted to support the packs against the force of the impingement of the water jet, and pusher bars driven by the drive means and engageable with the packs on the conveyor to advance them along the bed.

6. Apparatus according to claim 5 wherein the bed has a hole through which the water jet passes after cutting through the packs and cigarettes, and a tube is arranged in sealed relation to the perimeter of the hole on the under side of the bed to receive and confine the water jet.

7. Apparatus according to claim 6 and further comprising vacuum aspirator means coupled to the tube for maintaining a vacuum in the tube and for aspirating water splash from the jet as it impinges on the packs.

8. Apparatus according to claim 5 wherein the water jet is directed against the packs at an angle oblique to the bed with a velocity component in a direction opposite to the direction of movement of the packs along the indexing conveyor, whereby the jet impinges initially at the lower leading corner of each pack as the cut is initiated and the cut propagates upwardly along the leading edge of the pack.

9. Apparatus according to claim 5 wherein the indexing conveyor further includes an endless driven chain on either side of the bed and a row of uniformly spaced-apart pusher bars carried by each of the drive chains, the pusher bars extending orthogonally to the path of movement of the packs along the bed part way across the bed for engagement with the trailing narrow side walls of packs and having free ends spaced apart so that the pusher bars do not pass through the water jet.

10. Apparatus according to claim 9 wherein the chain on the side of the bed remote from the second conveyor carries stop bars located to be engaged by the ends of the packs and establish their transverse positions on the indexing conveyor.

11. Apparatus according to claim 10 and further comprising means at the receiving station of the indexing conveyor for counteracting rebounds of the arriving packs and establishing engagement of the packs with the respective stop bars.

12. Apparatus according to claim 11 wherein the rebound-counteracting means is a brush located above the packs, engageable with them and driven in rotation in a direction to move them into engagement with the respective stop bars.

13. Apparatus according to claim 1 and further comprising a rotatable dancer roll at the end of the first conveyor that is adapted to maintain frictional engagement of each pack with the first conveyor for movement at the first velocity until it disengages from the roll, whereby the point of transfer from the first conveyor to the second conveyor with respect to the trailing end of each pack is substantially uniform from pack to pack and substantial uniformity of the spacing between the packs on the second conveyor is ensured.

* * * * *